US005695375A

United States Patent [19]

Takemura et al.

[11] Patent Number: 5,695,375

[45] Date of Patent: Dec. 9, 1997

[54] DISPERSE DYE-DYEABLE REGENERATED CELLULOSE FIBER AND TEXTILE PRODUCTS CONTAINING THE FIBER

[75] Inventors: Osamu Takemura, Osaka; Naoki Tanimoto, Kurashiki; Eiji Iwasa, Kurashiki; Ichirou Inoue, Kurashiki; Tsutomu Kawamura, Saijyo; Kiyoshi Hirakawa, Kurashiki; Shinichi Ono, Osaka; Hitoshi Kimura, Osaka; Mitutake Aruga, Osaka, all of Japan

[73] Assignee: Kuraray Co., Ltd., Okayama, Japan

[21] Appl. No.: 777,700

[22] Filed: Dec. 20, 1996

Related U.S. Application Data

[62] Division of Ser. No. 532,827, filed as PCT/JP95/00215, Feb. 16, 1995.

[30] Foreign Application Priority Data

| | | | |
|---|---|---|---|
| Mar. 1, 1994 | [JP] | Japan | 6-56697 |
| Jun. 29, 1994 | [JP] | Japan | 6-171967 |
| Jun. 29, 1994 | [JP] | Japan | 6-171968 |
| Dec. 16, 1994 | [JP] | Japan | 6-334237 |
| Dec. 16, 1994 | [JP] | Japan | 6-334238 |
| Dec. 16, 1994 | [JP] | Japan | 6-334239 |

[51] Int. Cl.[6] ..... D02G 3/00; D06P 3/82; B32B 27/00

[52] U.S. Cl. ..... 442/217; 8/532; 427/372

[58] Field of Search ..... 442/217; 8/532; 428/372

[56] References Cited

U.S. PATENT DOCUMENTS

| | | | |
|---|---|---|---|
| 3,642,424 | 2/1972 | Lowenfeld et al. | 8/532 |
| 3,713,767 | 1/1973 | Lowenfeld et al. | 8/532 |
| 4,833,012 | 5/1989 | Makimura et al. | 428/288 |

*Primary Examiner*—Newton Edwards

*Attorney, Agent, or Firm*—Oblon, Spivak, McClelland, Maier & Neustadt, P.C.

[57] ABSTRACT

Novel regenerated cellulose fiber dyeable with disperse dye is disclosed. In this regenerated cellulose fiber, 10 to 40 weight % of polyester fine particles or styrene-acrylic polymer fine particles having an average particle size of 0.05 to 5 μm are compounded. Products wherein the regenerated cellulose fiber and polyester fiber are used in combination can give dyed products excellent in homochromatic properties, and since both fibers can be dyed at the same time, the dyeing efficiency is remarkably improved.

3 Claims, 1 Drawing Sheet

DISPERSE DYE-DYEABLE REGENERATED CELLULOSE FIBER AND TEXTILE PRODUCTS CONTAINING THE FIBER

This is a Division of application Ser. No. 08/532,827 filed on Oct. 27, 1995, pending, which was filed as International Application No. PCT/JP95/00215, on Feb. 16, 1995.

TECHNICAL FIELD

The present invention relates to disperse dye-dyeable regenerated cellulose fiber and a method for producing the same, and a textile product containing the fiber. More specifically, the present invention relates to a textile product comprising the fiber and a polyester fiber, and a method for dyeing the same products.

TECHNICAL BACKGROUND

Heretofore, regenerated cellulose fibers represented by viscose rayon and cuprammonium rayon have been dyed with direct dyes, reactive dyes or indanthrene dyes. It has been impossible to dye regenerate cellulose fibers with other dyes (e.g., disperse dyes).

However, dyeing with these dyes which have so far been used has never been satisfactory. For example, direct dyes are not satisfactory in color fastness in some colors, and although dyeing with reactive dyes gives good color fastness, reactive dyes are expensive and have a problem on productivity because dyeing for long hours with alkalis under high pH values and high temperatures is necessary. Further, indanthrene dyes have drawbacks that they are expensive and lack general purpose-properties since usable colors are limited.

As seen, for example, in cationization or anionization, a history of study to improve dyeability of regenerated cellulose fiber is long, but these means given therefrom do not provide satisfactory color fastness and also result in substantial lowering in fiber strength due to addition of various compounds to fiber, and thus lack practicability, and are now not industrially conducted.

Thus, although various attempts have so far been made to improve dyeability of regenerated cellulose fiber, fully satisfactory results have not been obtained when assessment is made taking up to color fastness and physical properties of fiber into account.

On the other hand, regenerated cellulose fiber has come to be frequently used, in resent years, together with synthetic fibers such as polyester fiber, in order to make the best use of excellent hygroscopicity and peculiar feeling of regenerated cellulose fiber for outer clothing.

However, as mentioned above, regenerated cellulose fiber is dyed with direct or reactive dye, whereas polyester fiber is dyed with disperse dye. Thus, when fabric or knitted webs comprising regenerated cellulose fiber and polyester fiber are dyed, there are troublesomeness that the polyester fiber should be dyed with disperse dye and regenerated cellulose fiber should be dyed with reactive or direct dye.

Although this dyeing process is a process actually carried out at present, the process takes long time to dye regenerated cellulose fiber, and it is the present state of things that dyeing treatment of the order of only 3 batches a day per one dyeing machine is made at most. On the other hand, when polyester fiber alone is dyed with disperse dye, dyeing treatment of the order of 9 batches a day per one dyeing machine is possible.

Dyeing treatment ability on woven fabric or knitted webs comprising regenerated cellulose fiber and polyester fiber is extremely lower than that on woven fabric or knitted webs comprising polyester fiber alone so that dyeing costs of the former become higher. The higher dyeing costs are a cause of weakening the competitive position of woven fabric or knitted webs comprising regenerated cellulose fiber and polyester fiber against woven fabric or knitted webs comprising polyester fiber alone.

Even though, from the above point of view, if regenerated cellulose fiber dyeable with disperse dye as in polyester fiber were obtained, the above troublesomeness at the time of dyeing could be solved all at once, there has been no idea or emphasis to make regenerated cellulose fiber practically dyeable with disperse dyes as in the present invention.

Furthermore, not based on dyeing fiber, there is also known a spun-dyed fiber comprising adding various inorganic pigments to spinning solution for regenerated cellulose fiber, and a method comprising adding previously colored organic fine particles to spinning solution in order to improve the drawbacks of inorganic pigments and carrying out spinning. However, these methods are troublesome because the spinning solutions should be previously colored, and further, it is difficult to carry out uniform coloring. Moreover, since both inorganic pigments and organic pigments are poor in general purpose-properties because of limited kinds of color, it is, for example, almost impossible to match, in soft goods comprising regenerated cellulose fiber and synthetic fiber such as polyester fiber, the colors of both fiber into the same color.

Further, GB2008126A discloses a technique to add polystyrene fine particles to regenerated cellulose fiber for delusting purpose. However, in fact, polystyrene is not always dyeable with disperse dye, and there is no suggestion about making regenerated cellulose fiber dyeable with disperse dye in the above patent publication. Furthermore, the addition amount of polystyrene fine particles is as small as 5 weight % at most, and therefore, even if the fine particles were dyeable with disperse dye, the regenerated cellulose fiber could not be regarded as disperse dye-dyeable fiber.

The first objection of the present invention is to provide regenerated cellulose fiber, inexpensively and in good productivity, which is, of course, dyeable by dyeing methods using conventional direct dye or reactive dye which have been used for regenerated cellulose fiber, and, moreover, dyeable with disperse dye being superior in color fastness without causing the above problem in the conventional dyeing methods nor causing large lowering of fiber strength.

The second object of the present invention is to provide regenerated cellulose fiber which, when it is used together with synthetic fiber such as polyester fiber, can be dyed together with the synthetic fiber with disperse dye alone in the same dye bath at the same time, and is suitable for preparing textile products having homochromatic properties in accordance with desire.

Further, the third object of the present invention is to provide a dyeing method to secure, when regenerated cellulose fiber is dyed together with polyester fiber with disperse dye, high homochromatic properties between both fibers.

DISCLOSURE OF THE INVENTION

According to the present invention are provided regenerated cellulose fiber containing 10 to 40 weight % of polymer fine particles with an average particle size of 0.05 to 5 μm which are dyeable with disperse dye, and color fastness (grade) to washing of the third grade or better, and a fiber comprising said fiber dyed with disperse dye. According to the present invention are further provided a textile product comprising regenerated cellulose fiber containing 10 to 40 weight % of polymer fine particles with an average particle size of 0.05 to 5 μm which are dyeable with disperse dye, and polyester fiber, and the textile product comprising the both fibers dyed with disperse dye.

THE BEST MODE FOR CONDUCTING THE INVENTION

Figure 1:
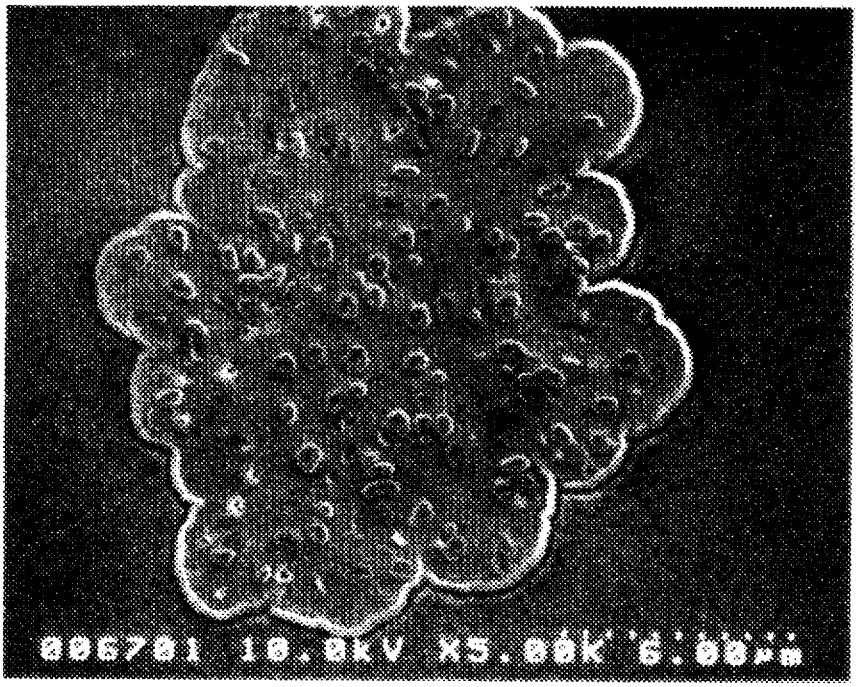
FIG. 1 is an scanning electron photomicrograph showing an example of the section of the fiber of the present invention. As understood from this, the polymer fine particles are randomly dispersed without forming extreme aggregates at the fiber section.

In the present invention, the regenerated cellulose fiber means rayon fiber obtained by using viscose as a main spinning solution (hereinafter, merely abbreviated as viscose rayon) ahd cuprammonium rayon fiber, and includes both long fiber and short fiber. Cellulose fibers such as diacetate fiber and triacetate fiber which are inherently dyeable with disperse dye are not the subject of the present invention.

The textile products in the present invention includes not only staple fiber, spun yarn, filament yarn, string, woven fabric, knitted fabric and nonwoven fabric, and clothes, living materials, industrial materials, sundries and daily needs in all of which these are used, but also such textile products in at least part of which the present regenerated cellulose fiber is used.

It is important that the regenerated cellulose fiber in the present invention contains 10 to 40 weight % thereof of polymer fine particles dyeable with disperse dye.

The polymer dyeable with disperse dye (hereinafter, sometimes merely abbreviated as raw polymer) means a polymer showing a degree of exhaustion of 60% or more under the standard conditions described below, and includes, for example, polyamides such as nylon 6 and nylon 66, polyesters such as polyethylene terephthalete and polybutylene terephthalate, polymethyl methacrylates, methyl methacrylate-methacrylic acid copolymers, methyl methacrylate-methacrylic acid-styrene copolymers, acrylic acid-stylene polymers, acrylonitrile-styrene polymers, and urethane polymers. In view of dyeability of raw polymer with disperse dye and color fastness, thermoplastic polymers such as polyester polymers and acrylic polymers are preferably used.

When the regenerated cellulose fiber of the present invention is used together with synthetic fibers such as polyester fiber, polyester polymer fine particles are preferably used as raw polymer considering homochromatic properties between both fibers after dyeing. However, since some kinds of polyester plastic fine particles rapidly decompose with the alkali in viscose and have possibility of decomposition in viscose, it is preferable that when a polyester is used, the solubility and decomposability thereof are previously checked, and when a polymer having high solubility and/or high decomposability is used, measures for retarding decomposition of the polyester are taken such as making the time from addition thereof to the viscose to spinning as short as possible and treating the viscose after the addition at low temperatures.

As stated above, it is fundamentally preferable to use polymer fine particles having good color fastness, the regenerated cellulose fiber of the present invention often shows better color fastness than that of the raw polymer even when the color fastness of the polymer fine particles themselves is not so good, presumably because these fine particles are dispersed in such a state that they are embedded in the regenerated cellulose.

The average particle size of the polymer fine particles used in the present invention is 0.05 to 5 μm. In the case of under, although lowering of yarn-making properties and lowering of the physical properties of the fiber do not occur so often, problems are liable to occur that dyeability with dyes and/or fastness are lowered and the polymer fine particles, depending on the kind of polymer comprising the fine particles, tend to be easily eluted by organic solvent treatment as in dry cleaning. Thus, the lower limit is preferably 0.1 μm, particularly 0.2 μm. On the other hand, when the average particle size is beyond 5 μm, there arises a case where clogging of the spinning nozzle and occurrence of fluff frequently take place and thus stable yarn-making becomes impossible, and moreover, the strength and elongation of the resultant fiber is low and lowering of the toughness is striking.

When physical properties of the fiber are particularly regarded as important, an upper limit of an average particle size of fine particles is preferably 3.5 μm, more preferably 2.5 μm, particularly preferably 1.5 μm. Further, when the whiteness or yellowness of the resultant fiber is taken into account, it is preferable to use fine particles having an average particle size of 1 μm or less.

Such polymer fine particles can be prepared by, for example, a physical fine particle-making method comprising freeze pulverizing polymer chips or powder using a known crusher into fine particles, or polymerization technique such as a method comprising carrying out particle formation in the course of polymerization of polymerizable monomers or a method comprising carrying out particle formation from a solution of the polymer made into fine droplets.

The fine particle-making method may be selected in accordance with the order of an average particle size of the particles used. However, in practice, according to a kind of polymers, crush thereof to an order of micron to submicron is extremely difficult or the preparation of the fine particle is impossible even with the polymerization technique.

for example, when the polymerization technique is applied, in order to obtain the fine particles having a particle size of the order of 0.05 to 1 μm, an emulsion polymerization method, a soap-free emulsion polymerization method and a seed emulsion polymerization method are preferably adopted, and for that of 1 to 5 μm, a seed emulsion polymerization, a two-stage swelling method, a dispersion polymerization method, and the like are preferable.

These polymer fine particles can be solid fine particles or hollow fine particles. When hollow fine particles are used, it is possible to realize high masking properties and weight saving of the fiber at the same time.

It is necessary that the regenerated cellulose fiber of the present invention contains such polymer fine particles in an amount of 10 to 40 weight %. When the content is lower than the lower limit value, the amount of dye in fiber is not sufficiently secured, and thus coloring properties become poor and it becomes impossible to obtain deeply dyed products. On the other hand, when the content is beyond 40 weight %, fluff is liable to occur at the time of yarn-making and lowering of physical properties of the fiber also becomes striking. From view of balance between physical properties of the fiber and amount of dye in fiber capable of broadly covering dyeing from light dyeing to deep dyeing, the preferred lower limit value of the content is 15 weight and the upper limit is 30 weight %. Provided that the content falls into the above range, the kind of the polymer fine particles is not limited to one kind, and the polymer fine particles comprising two or more different kind of polymers may be used mixedly, or the polymer fine particles comprising a single kind of the polymer but having different particle size distributions may be used together.

FIG. 1 is a scanning electron photomicrograph illustrating an example of a section of the fiber of the present invention. As understood from this, the polymer fine particles are randomly dispersed at the section of fiber, without forming extreme aggregates. Usually, viscose rayon, of which section is shown in FIG. 1, has skin-core structure formed at the time of coagulation, the skin part near the fiber surface is composed of smaller fine crystals than the core part and the minute structure changes in the sectional direction. Therefore, there is no guarantee that, in the course of coagulation, the viscose contained the polymer fine particles solidifies to regenerate the fiber in such a state that the polymer fine particles are uniformly dispersed within a section of the fiber. However, as seen in FIG. 1, they are actually dispersed randomly, which is considered to prevent and minimize expected lowering of the physical properties of fiber when they would be unevenly distributed and mainly exist at the core part.

Moreover, in the regenerated cellulose fiber of the present invention, in proportion as the content of the polymer fine particles increases, it is observed that part of the polymer fine particles project over the surface of the fiber or the fine particles which projected drop out to form a crater-like hollow part, and thereby is given such a structure that the fiber surface is toughened, and as a result the luster of the fiber becomes mild. The regenerated cellulose fiber of the present invention, which takes such fiber surface structure, has a coefficient of static friction (fiber-fiber) of as high as about 0.32 or more, and is excellent in stability of package, compared with usual yarn package. On the other hand, the coefficient of static friction (fiber-metal) thereof is about 0.28 or less, and lower than the coefficient of static friction (about 0.32) of the fiber in the case where the fine particles are not added, and thus the regenerated cellulose fiber of the present invention has an excellent characteristic, for example that abrasion of the pins at the time of false twisting (boundary lubrication) does not so come into question. Further, the coefficient of dynamic friction (fiber-metal) thereof is about 0.33 or less, and lower than the coefficient of dynamic friction (about 0.5) of the fiber in the case where the fine particles are not added, and thus the regenerated cellulose fiber of the present invention has an effect that problems on abrasion seldom occur in the processing step at an ordinary processing speed.

On the other hand, in order to make the fiber of the present invention dyeable with disperse dye while it holds the luster of usual rayon, it is suitable to intentionally adopt a spinning method to give a fiber on the surface of which fine particles do not exist. For example, this can be achieved through a method which comprises carrying out bicomponent spinning according to a process for preparation of sheathcore type conjugate fiber using as the core component viscose containing the polymer fine particles and as the shell component viscose not containing the fine particles. However, in that case, as mentioned above, if the content of the fine particles is not made to be rather low, there is the possibility that physical properties the fiber are lowered. There is still a case where the luster peculiar to rayon can be maintained by using the fine particles having an extremely small particle size in place of spinning into the sheathcore structure. Particularly, when the fine particles having an average particle size of 0.5 μm or less are used, the fiber of bright luster is obtained, and therefore, it is possible to choose the fine particles having a particle size in accordance with desire.

Further, in the present invention, it is also possible to spin a sheathcore type conjugate fiber adding the polymer fine particles intentionally only to the shell component, or to spin a side-by-side type conjugate fiber.

The regenerated cellulose fiber of the present invention wherein such fine particles are compounded exhibits dyeing behavior toward disperse dye analogous to usual polyester fiber, and good dye absorption properties. The absorption amount of dye can appropriately be settled in accordance with dyeing conditions, e.g., whether deep color dyeing or light color dyeing is adopted, but the regenerated cellulose fiber of the present invention has an ability being dyed with disperse dye of preferably 0.1 mg or more, more preferably 1 mg or more, particularly 4 mg or more per g of the fiber weight. It is not recommended to adopt an amount of dye in the fiber under 0.1 mg/g because sufficient coloring properties cannot be obtained at that amount even in the case of light color dyeing. The upper limit of the carried amount does not have a critical significance because it largely changes depending on dyes used, but is desirably 200 mg/g or less taking efficient use amounts of dyes in deep color dyeing into account.

As to methods of measuring an amount of dye in the fiber, measurement methods are different between fiber after dyeing and fiber before dyeing, and, for example, in the case of products dyed with single dye, an amount of dye in the fiber can be determined by subjecting a predetermined amount of fiber to Soxhlet extraction with aqueous 57% pyridine solution, diluting the extract with aqueous 57% pyridine solution to adjust to a proper dye concentration, measuring absorbance at the maximum absorption wavelength using a spectrophotometer [Hitachi 307-type color analyzer (produced by Hitachi Co., Ltd.)], and applying the absorbance to a separately prepared calibration curve.

As to undyed fiber, the carried amount can be determined according to a method as later described.

In the fiber of the present invention, the polymer fine particles themselves are dyeable with disperse dye, but surrounded by cellulose molecules undyeable with disperse dye, and thus such a fiber structure that disperse dye molecules cannot directly contact with the fine particles is formed. Although the reason why, nevertheless, the fine particles are dyed with the disperse dye is not clear, it is surmised that the regenerated cellulose fiber is swelled with water during the dyeing treatment, the molecular motion of the cellulose becomes active, molecules of the disperse dye permeate places where the arrangement of the cellulose became loose, and as a result the fine particles are dyed with the dye molecules. This phenomenon is just an unexpectable fact when it is taken into account that even an attempt to dye regenerated cellulose fiber with disperse dye has hitherto not been made. Further, a fact that even when the fiber dyed with disperse dye is washed (water washed) and thereby the fiber is swelled again and put in such a circumstance that the dye is easy to eliminate, the dye is still strongly sticking to the fine particles, and the fiber exhibits an excellent color fastness of the third grade or better is also just unexpectable.

The regenerated cellulose fiber of the present invention, which is dyeable with disperse dye, is referred as to "disperse dye-dyable" regenerated cellulose fiber, in addition thereto, also including its good fastness to washing after dyeing. Specifically, the regenerated cellulose fiber of the present invention, when subjected to dyeing treatment under the following conditions (hereafter, sometimes merely abbreviated as standard dyeing condition ), exhibits a degree of dye exhaustion of 60% or more, particularly preferably 70% or more and a fastness to washing of the third grade or better. More desirably, the regenerated cellulose fiber of the present invention has, in addition to the above properties, such color fastnesses that color fastness to dry cleaning is the third grade or better, color fastness to sublimation is the third grade or better and color fastness to light against carbon arc lamps is the third grade or better.

| <Dyeing condition> | |
|---|---|
| Dye; Sumikaron Brill Red SE-2BF (produced by SUMITOMO CHEMICAL COMPANY, LIMITED) | 3% owt |
| Auxiliary; Disper TL | 1 g/l |
| Ultra MT Level | 1 g/l |
| Bath ratio; 1:50 | |
| Dyeing temperature and time; 120° C. × 40 minutes (temperature is increased in 30 minutes from 40 to 120° C. ; maintained at 120° C. for 40 minutes) | |
| Reduction cleaning; NaOH 1 g/l, $Na_2S_2O_4$, 1 g/l and Amiladin (produced by Dai-ichi Kogyo Seiyaku Co., Ltd.) 1 g/l, 80° C. × 20 minutes | |
| Water washing; | 30 minutes |
| Drying; 60° C. × 10 minutes | |

The degree of exhaustion of disperse dye in the present invention is a value determined by the following method when a fiber is dyed under the standard dyeing condition.

$$\text{Degree of exhaustion } (\%)=[(S_0-S_1)/S_0]\times 100$$

$S_0$; Absorbance at the maximum absorption wavelength measured by a spectrophotometer [Hitachi 307-type color analizer (produced by Hitachi, Ltd.)] on a dye solution prepared by diluting a dye solution before dyeing with an aqueous acetone solution (acetone/water=1/1 in volume ratio) at the prescribed dilution $S_1$; Absorbance at the maximum absorption wavelength measured by a spectrophotometer on the dye residual solution after dyeing, or on a solution prepared by diluting, according to necessity, the dye residual solution with an aqueous acetone solution (acetone/water=1/1 in volume ratio) at the prescribed dilution Further, when dilution is carried out, it is desirable to carry out the dilution so that the maximum value of the absorbance may be around 0.6. There is a case where dilution is carried out on the dye solution before dyeing and it is unnecessary to dilute the dye residual solution because of a low dye concentration, and in this case, it is necessary to calculate the degree of exhaustion from the value obtained by multiplying the dilution of the dye solution before dyeing to the absorbance of the dye residual solution after dyeing.

A characteristic of the present invention is, as stated above, that the fiber exhibits extremely good fastness in various color fastness tests. Such color fastness is excellent color fastness of just the same level as usual polyester fibers. In addition, the fiber of the present invention exhibits, besides these color fastnesses, a color fastness to wet rubbing of the second grade or better, particularly the third grade or better.

The above various color fastnesses in the present invention were determined according to the following methods.

| |
|---|
| Color fastness to washing; JIS L0844-1986 (A-2 method) (cotton cloth and nylon cloth were used as attached cloth) |
| Color fastness to dry cleaning; JIS L0860-1974 (cotton cloth and nylon cloth were used as attached cloth) |
| Color fastness to sublimation; JIS L0850-1975 (B-2 method) (the temperature and time of hot pressing were made to be 160° C. and 60 seconds, respectively, and polyester cloth was used as attached cloth) |
| Color fastness to light when a carbon arc lamp was used; JIS L0842-1988 (the third method for exposure to light was used as the method for exposure to light) |
| Color fastness to wet rubbing; JIS L0849-1971 (IItype tester was used) |

Processes for preparation of the regenerated cellulose fiber of the present invention are described below.

Addition of the polymer fine particles to fiber can be carried out in any of the steps before the spinning solution is discharged through the nozzle for spinning. Although it is possible to add the polymer fine particles by themselves directly to the spinning solution, the fine particles tend to aggregate when this method is adopted, and therefore, it is preferable to previously prepare an aqueous dispersion of the fine particles, add the dispersion to the spinning solution so as to give a predetermined concentration, and mix the mixture. Further, it is also possible, instead of separately preparing such an aqueous dispersion, to prepare, from the beginning, a spinning solution wherein the fine Particles are compounded to give a predetermined concentration.

When various grades of the fiber containing the fine particles in different concentrations are produced, it is more rational to separately prepare the aqueous dispersion, and add the dispersion to the line of the spinning solution so as to match the grade, and mix the mixture.

Preparation of the aqueous dispersion should be conducted carefully so as to avoid coagulation of the fine particles therein, and for this, it is preferable to prepare the aqueous dispersion having a fine-particles concentration ranging from 10 to 50 weight %, particularly fro 15 to 30 weight %.

Further, in order to disperse the fine particles stably in the dispersion or the spinning solution, it is preferable to use a dispersion assistant. For example, when spinning of viscose rayon is particularly subjected as the regenerated cellulose fiber, it is preferable to add a nonionic dispersion assistant such as a polyoxyethylene alkylamino ether in an amount of 15 to 30 weight % based on the fine particles.

The regenerated cellulose fiber of the present invention can be prepared by adding the fine particles to the spinning solution, subjecting the fine particles to sufficient disperse and mixing by a dispersing means such as an agitating element, discharging the dispersion after defoaming and deaeration, through the spinning nozzle into a regeneration bath to give yarn, drawing the yarn, and reeling the yarn at a predetermined speed.

Although it is important, particularly in the present invention, for uniform dispersion of the fine particles into the spinning solution, to carry out sufficient stirring and mixing after the addition, it is not desirable to carry out spinning using an excessively stirred spinning solution because yarn-making properties are lowered. Defoaming of the spinning solution is also very important in spinning, and if defoaming is not sufficiently carried out, stable spinning is hindered. Therefore, it is preferable to use the spinning solution after standing defoaming of the order of 16 to 30 hours or vacuum defoaming of the order of 1 to 24 hours.

The preparation process of the present invention is described below taking as an example a case where the regenerated cellulose fiber is viscose rayon. Viscose rayon prepared by usual processes has a strength at the time of wetting of as low as under 1 g/d, and when spinning is carried out adding a third component to the viscose, the strength is usually further lowered, and thus a practically usable fiber is not be afforded in many cases.

In the present invention, it is preferable, for preventing lowering of the strength of fiber obtained, to control the wet strength of the fiber to 0.4 g/d or more, preferably 0.45 g/d or more by adjusting the alkali concentration of the viscose to 6.5 to 8 weight %, particularly preferably 7 to 7.5 weight % and adjusting the draw ratio to the order of 15 to 25%.

When the alkali concentration is above 8%, problems, for example that spinning speed is lowered and scouring becomes insufficient are liable to occur due to delay of coagulation and regeneration. On the other hand, in the case of under 6.5%, it is difficult to make the wet strength fall into the range in the present invention. As to the degree of ageing and viscosity of viscose, known conditions can be adopted, and, for example, a condition of the degree of ageing being 8 to 15 cc and the viscosity being 20 to 60 Poise can be adopted.

Further, the bath composition of the coagulation and regeneration bath is, for example, a composition of sulfuric acid being 8 to 12%, sodium sulfate being 13 to 30% and zinc sulfate being 0 to 2%, and the bath temperature is generally 45° to 65° C.

In preparation of the fiber of the present invention, it is important on addition and dispersion of the fine particles into viscose to take notice of the following points.

(1) In any of viscose, aqueous alkali solution and aqueous fine particle dispersion, agitation is carried out so as to make uptake of foam lowest.

(2) When the aqueous fine particle dispersion is mixed, it is preferable to carry out agitation at a high speed of about 400 rpm or more and at a maximal number of revolution free from uptake of air.

(3) It is preferable to add the aqueous fine particle dispersion to the aqueous alkali solution of a concentration as low as possible, and when a thick solution is prepared by an immediately-before-spinning mixing method, it is preferable to add the dispersion to an aqueous alkali solution of 20% or less, particularly 15% or less as slowly as possible.

(4) Thus, it is recommended to mix first an aqueous alkali solution for correction of alkali concentration with the viscose and then add the aqueous fine particle dispersion gradually.

(5) It is preferable that the concentration of the aqueous fine particle dispersion to be added to the viscose is also as low as possible. The fine particle concentration of 30% or less, particularly 25% or less is preferable.

(6) It is preferable, in view of dispersion stability, to carry out mixing so that the fine particle concentration after addition to the viscose can be 15% or less, particularly 10% or less.

(7) Since when a dispersion assistant is contained in a large amount for enhancement of dispersibility of the fine particles, defoaming properties are lowered, it is preferable to carry out agitation at a low speed so that the whole liquid can move and the foam can readily move toward the upper part of the liquid.

As to preparation apparatuses themselves, viscose rayon preparation apparatuses which so far been known can be used. Specifically, it is possible to use centrifugal spinning machines, bobbin-type spinning machines, Nelson's continuous spinning machines, drum-type continuous spinning machines, Kuljian's continuous spinning machines, industrial-type continuous spinning machines, Oscar-Kohorn's continuous spinning machines, net process-type continuous spinning machines, etc. The spinning speed is generally 50 to 400 m/min., and as to scouring, water washing and drying conditions, conditions which have so far been known can be adopted as they are.

When high speed spinning of 200 m/min or more is carried out, it is preferable to use flow tube-type spinning apparatuses.

Although, in the above description, examples wherein the alkali concentration of the viscose and draw ratio are changed from usual conditions are taken, the regenerated cellulose fiber of the present invention is not limited only to fiber obtained according to such method. For example, in preparation of regenerated cellulose fibers other than viscose rayon, it is possible to attain the object by changing spinning speed and/or draw ratio. Further, when, as polymer fine particles to be used, those insoluble in organic solvents are selected, the technique of the present invention can be applied to cellulose fiber obtained by a solvent spinning method which comprises dissolving cellulose in an organic solvent and carrying out spinning.

Rayon yarn obtained by preparation by continuous spinning machines seldom has uneveness of properties in the direction of the length of yarn, compared with cake yarn, and is suitable for clothing. On the other hand, as to preparation of the viscose rayon in the present invention, in the case of cake yarn prepared by centrifugal spinning machines, dyeing yield uneveness with disperse dye in the outer layer, the intermediate layer and the inner layer are extremely improved.

When cake yarn (about 600 g) is divided in equal by weight 11 parts in the direction of the length of the yarn, and pieces of yarn corresponding to the outermost layer and the innermost layer are designated layer 0 and layer 10, respectively, the above mentioned outer layer, intermediate layer and inner layer of cake yarn are defined as layer 0, layer 5 and layer 10, respectively. Yarn within each layer above is treated as yarn from the same layer. Difference (R) in dyeing yield between layers can be determined by measuring difference of color strength by Hanter's method (measurement of L, a and b) to the standard white plate (X; 78.73, Y; 81.56, Z; 98.38), on products obtained by dyeing fabrics made of yarn of each layer, using a color computer [Suga (in Japan), S & M Color Computer Model SM-4], and subtracting the minimum measurement value from the maximum measurement value.

In rayon cake yarn of the present invention, this R value becomes 2 or less, particularly 1.5 or less. However, in order to make the difference (R) in dyeing yield with disperse dye between the inner layer and the outer layer small as in the present invention, it is desirable, when the average value of the content of the fine particles contained in the cake yarn is designated n, that the fine particles are dispersed and compounded in the range of n±0.1 n in the length direction of the cake yarn. It is important, for the purpose, to disperse the fine particles uniformly in the spinning solution (viscose dope), and, specifically, it is important, as stated above, to carry out sufficient agitation and mixing after addition of the fine particles. However, attention should be payed to the fact that when spinning is carried using a spinning solution containing air as a result of excessive agitation, yarn-making properties are lowered.

In order to attain uniform dispersion, the influence of the size of the fine particles cannot be neglected. That is, the concentration gradient occurs due to difference in specific gravity between the spinning solution viscose and the fine particles, and as to this point, the fine particles having a lower particle size tend to be stabler and harder to separate, as stated above. Anyway, it is necessary to make aggregation of the fine particles small and hold the dispersion state uniform during agitation and defoaming after the addition, and, therefor, adoption of moderate agitation conditions and agitation at low speeds during defoaming are necessary.

Moderate agitation does not mean adding excessive foam into the viscose by excessive high speed agitation, but means carrying out agitation at such a maximum speed that uptake of foam into the viscose is made to be as small as possible.

Further, it is also necessary to carry out agitation during vacuum defoaming and standing defoaming at low speeds of the order of 40 to 50 rpm, and thereby, defoaming is carried out smoothly and, at the same time, the dispersion stability of the fine particles becomes good. Particularly, when the difference in specific gravity between the viscose spinning solution and the fine particles is large or when the particle size is large, in the case where such low speed agitation is not made, separation of the fine particles is apt to take place in the thick dispersion tank, the content of the fine particles in the length direction of yarn after yarn-making becomes inconstant, resulting in difference in dyeing.

As stated above, although production of rayon cake yarn having no difference in dyeing between the inner layer and the outer layer is made to be possible by selection of polymer fine particles, size of the fine particles, addition amount of the fine particles, a countermeasure against lowering of physical properties by the addition and control of the content of the fine particles, it is, of course, better to further reinforce denier compensators and uniform dyeing guide compensators at the time of production of rayon cake yarn which have so far been carried out. This compensator is one for making as small as possible occurrence of difference in fineness, difference in physical properties and difference in dyeing between the inner layer and the outer layer of the rayon cake yarn due to change with time lapse of centrifugal force at the time of centrifugal take-up of the cake yarn. Usually, gradual increase of speed is applied for softening of difference in fineness, and gradual strengthening of the guide angle is applied for softening of differences in physical properties and dyeing.

However, in proportion as layers change from outside to inside, spinning speed and tension tend to increase and fluff and snapping of yarn also tend to increase, and therefore, it is not desirable to give compensator too much.

According to the present invention, good results are obtained, with almost no relation to difference in dyeing between the inner layer and the outer layer, even if compensator is not given at all.

The regenerated cellulose fiber of the present invention are dyeable with disperse dye, as stated above, and this characteristic is shown with maximum effect on textile products in which the regenerated cellulose fiber and synthetic fiber such as polyester fiber coexist. It is not particularly limited how both fibers coexist in the textile products. For example, both fibers can coexist as yarn in conjugate forms obtained according to methods, for example, intermingle by twisting, interlace treatment, Taslan treatment, etc., false twisting after plying, plying in line spinning process, mixed spinning, and the like, or as fabric in such forms that yarns are combined according to methods such as alternate knitting and alternate weaving where the respective yarns are used independently and separately.

It goes without saying that it is possible to give twisting usually applied, in accordance with desired fabrication, to yarn prior to knitting or weaving, but in the case of alternate weaving, it is preferable to avoid giving strong twisting (1,500 turns/m or more) to the regenerated cellulose fiber and using the resultant yarn as all warp yarn and all filling yarn of woven fabric, because stability to shrinkage cannot be obtained. However, this is not applied to conjugate yarn.

The ratio of polyester fiber to the regenerated cellulose fiber in textile products can variously be changed in accordance with conjugate forms of both and use.

Textile products mainly comprising the regenerated cellulose fiber are preferable because it is possible to fully utilize the unique feeling and functionality (hygroscopicity, static resistance, etc.) of the fiber.

On the other hand, polyester fiber, for example when combined with regenerated cellulose fiber into yarn, plays an important role of giving reinforcement of strength and form stability, which are drawbacks of regenerated cellulose fiber. In designing of such textile products, it is preferable that the rate of polyester fiber is 30 to 50 weight %. In the case of under 30 weight %, there may arise a case where strength is too low for outer clothing, or form stability cannot be obtained because of high washing shrinkage. On the other hand, in the case of above 50 weight %, there may arise a case where difference in feeling from woven fabric and knitted webs made of polyester fiber alone becomes unclear.

In the present invention, although it is possible to dye regenerated cellulose fiber and polyester fiber in textile products so as to give different colors, textile products excellent in homochromatic properties can be obtained by utilizing a characteristic that both fibers are dyeable with the same disperse dye.

Homochromatic properties $\Delta E^*$ referred to in the present invention is a value determined by taking out from regenerated cellulose fiber and polyester fiber in textile products dyed, measuring $\Delta L^*$, $\Delta a^*$ and $\Delta b^*$ using the following measurement system, and applying these values to the following equation. In the present invention, when $\Delta E^*$ value is 4 or less, the textile product tested is regarded as having excellent homochromatic properties. When $\Delta E^*$ goes beyond 4, the feeling of different color gradually come to be recognized visually.

<Measurement system>

SICOMUC 20 (produced by Sumika Analitical Center Co., Ltd.)

Macbeth spectrophotometer (light source D65)

Measurement is carried out according to such a measurement mode that the measuring light permeates the sample, using a slit of width 2 mm×length 20 mm.

Although colorimetry of a piece of yarn is possible by this measurement system, it is also possible to carry out colorimetry using, if necessary, plural pieces of yarn (n=5, sampling is made at a load of 0.1 g/d).

$$\Delta E^* = \sqrt{\{(\Delta L^*)^2 + (\Delta a^*)^2 + (\Delta b^*)^2\}}$$

wherein $\Delta L^*$, $\Delta a^*$ and $\Delta b^*$ denote L* difference, a* difference and b* difference, respectively, by CIE 1976 L* a* b* color specification expression.

Polyester fibers used in the textile producers of the present invention include, for example, fibers composed of polyalkylene terephthalates such as polyethylene terephthalate and polybutylene terephthalate. The polyalkylene terephthalate may be a polyalkylene terephthalate with which is copolymerized as a third component in an amount of 20 mol % or less at least one of dicarboxylic acid components such as isophthalic acid, 5-metalsulfoisophthalic acid, naphthalenedicarboxylic acid, adipic acid and sebacic acid; glycol components such as ethylene glycol, propylene glycol, butylene glycol, hexamethylene glycol, nonanediol, cyclohexanedimethanol and bisphenol; polyoxyalkylene glycol components such as diethylene glycol, polyethylene glycol, polypropylene glycol and polybutylene glycol; polyhydric alcohol components such as pentaerythritol. These polyesters can be used alone or in combination of two or more. These polyesters may contain inorganic fine particles such as titanium oxide, silica, alumina and barium sulfate, and additives to give various functionalities.

The section of the polyester fiber is not limited to round section, and may also be triangular section, flat section, cross-shaped section, Y-section, T-section, C-section, etc., and can freely be selected in accordance with purposes. Further, when the effect of the present invention is not spoiled, the fiber of the present invention may be side-by-side type or sheathcore type conjugate fiber, or thick-and-thin type fiber having denlet variation in the length direction of the fiber.

The fineness of the polyester fiber can appropriately be settled in accordance with use purposes and is not particularly limited, but, for example, when conjugate yarn with the regenerated cellulose fiber is considered, it is preferable to use polyester fiber having a single fiber fineness of the order of 0.5 to 6 deniers so as to give a yarn fineness of the order of 20 to 150 deniers.

Methods for dyeing textile products of the present invention are described below.

Dyeability (dyeing initiation temperature, absorptivity, etc.) with disperse dye is not always the same between polyester fiber and the regenerated cellulose fiber. When homochromatic properties are not required between polyester fiber and the regenerated cellulose fiber, it causes no inconvenience that dyeabilities are different to some degree between polyester fiber and the regenerated cellulose fiber. However, when homochromatic properties are required between them, it is important to previously grasp the dyeability of each fiber with a dye to be used. Specifically, when the regenerated cellulose fiber and polyester fiber each having a degree of disperse dye exhaustion of 60% or more, particularly 70% or more are combined, middle deep color, particularly deep color is readily obtained.

Further, in order to obtain $\Delta E^*$ of 4 or less, it is desirable to carry out dyeing at temperatures in the range of 100° to 135° C. and further at temperatures selected so that the difference in degree of disperse dye exhaustion between both fibers can be within 15%, preferably within 10%, particularly preferably within 5%.

However, it is sometimes necessary to further restrict conditions depending on row polymer used.

For example, relation between dyeing temperature and degree of dye exhaustion when viscose rayon yarn containing 20 weight % thereof of styrene-acrylic polymer fine particles (HP91, OP62, OP84, etc. produced by Rohm & Haas Co.) was dyed alone, is nearly the same as in usual polyester filament (FOY) yarn alone (bath ratio=1:50). However, when these fibers are dyed at the same time in the same bath, the rayon yarn is more deeply dyed when the dyeing temperature is 100° C. or less, but when the temperature goes beyond 120° C., the relation is reversed, the rayon yarn is more lightly dyed, and heterochromatic properties between both fibers comes to stand out. The reason is that the dye moves from the rayon yarn to the polyester yarn.

In this occasion, in order to check dye movement and secure homochromatic properties, it is effective to lower bath ratio, shorten dyeing time and select dye. Although since specific conditions for obtaining homochromatic properties of textile product comprising rayon yarn and polyester yarn variously change depending also on kinds of dyes, it is difficult to settle the conditions sweepingly, but, dyeing temperature is 120°±5° C., dyeing time is 15 to 20 minutes and the bath ratio is 1:5 to 1:3. As to disperse dyes, it is preferable to use ones of the SE type or S type having comparatively large molecular weights, and when plural kinds of dyes are compounded, it is desirable to use one kind as a main dye, use the other dyes in an amount of the order of shading, and carry out color matching.

Although there is a case, depending on kinds of polymer fine particles, where homochromatic properties are attained even at under 100° C., textile products dyed at such temperatures are insufficient in the above-mentioned color fastness. Further, in the present invention where fibers having the above-mentioned degrees of disperse dye exhaustion are used, temperatures above 135° C. only consume large heat energy, and are not particularly necessary.

Although dyeing machines used in dyeing are different in accordance with forms of textile products, any dyeing machine can be used without particular problem so long as it is a dyeing machine used when polyester fiber is dyed with disperse dye.

The above dyeing conditions are mainly conditions, at comparatively low bath ratios, for realizing homochromatic properties of both fibers according to usual dip dyeing methods. However, even in the case of low bath ratios, when the dyeing method is a usual method, the amount of water to textile products as materials to be dyed necessarily becomes large, and dye molecules which once stuck to the regenerated cellulose fiber side are liable to move to the polyester fiber side during dyeing treatment.

Thus, in dyeing a textile product containing the regenerated cellulose fiber and polyester fiber with disperse dye, in order to enhance homochromatic properties, it is preferable to carrying out heat treatment with saturated aqueous vapor of 100° to 140° C. in such a state that the amount of water contained in the textile product having carried thereon the disperse dye was made to be 100% or less based on the fiber weight, and when the dye is carried on the textile product by such a means, movement of the dye from the regenerated cellulose fiber to the polyester fiber becomes small, and a textile product extremely excellent in homochromatic properties is obtained.

When water exceeding 100% based on the weight of a textile product exists, swelling of the regenerated cellulose fiber is liable to excessively take place, due to the excessive water, at the time of heating with saturated aqueous vapor, and the disperse dye once adsorbed on the polymer fine particles in the regenerated cellulose fiber tends to be detached from the fine particles, move to the polyester fiber side, and be carried thereon.

Methods for controlling the amount of water to textile products are specifically different depending on dyeing methods, and roughly classified into the case of dip dyeing methods and the case of textile printing methods. When dip dyeing methods are adopted, it is possible to adjust the amount of water to 100% or less, for example by introducing a textile product as a material to be dyed into a dye bath and squeezing excessive dye liquor (water) by a squeezing roller such as a mangle to adjust the amount of water to 100% or less. However, when the amount of water is decreases, mechanical limitation, for example, on the squeezing roller exists, squeezing uneveness are sometimes formed in squeezing excessive dye liquor (water) from the textile product and the uneveness becomes a cause of uneven dye, and therefore, it is necessary to make the amount of water to substantially 30% or more.

On the other hand, in the case of textile printing (print), since a textile product is printed with a color paste composition containing a disperse dye and dried at temperatures of 100° C. or more, the amount of water becomes 100% or less based on the textile product at stages before they are put into a steamer or the like, and therefore, there does not occur so much a problem of a scramble for the dye between both fibers due to excessive water, as in the above case.

In any case of dip dyeing and textile printing, it is important to heat treat the textile product wherein the disperse dye is attached on the fiber surface in an atmosphere of saturated aqueous vapor of 100° to 140° C. this heat treatment, the regenerated cellulose fiber moderately swells due to existence of high temperature saturated aqueous vapor, and molecules of the disperse dye permeate the fiber in such a state that the molecular arrangement became loose and are diffused into the fiber, and come to be easily carried on the polymer fine particles.

In the cases of ordinary pressure steaming at under 100° C., high temperature steaming using superheated steam of a saturation of under 100%, thermosol dyeing, etc., it is difficult to accomplish the objects of the present invention.

When the temperature of saturated aqueous vapor is under 100° C., the regenerated cellulose fiber and the polyester fiber become low in dyeability with the disperse dye, and deep color becomes difficult to obtain, which are not preferable. On the other hand, in the case of the temperature of saturated aqueous vapor being above 140° C., the regenerated cellulose fiber is deteriorated and the strength of the fiber is lowered, which are also not preferable. As to the temperature of saturated aqueous vapor preferable for giving dyed products of the regenerated cellulose fiber good color fastness to light, the lower limit is 120° C. and the upper limit is 135° C.

The time of heat treatment with saturated aqueous vapor is preferably 10 to 50 minutes, particularly preferably 20 to 40 minutes.

In textile products dyed according to such methods, relation A/B between the amount A of the disperse dye carried on the regenerated cellulose fiber and the amount B of the disperse dye carried on the polyester fiber becomes 0.70 or more, and thus, the textile products have a characteristic capable of achieving excellent homochromatic properties. The respective amount of dye in the fiber A and B can be determined by taking out the regenerated cellulose fiber and the polyester fiber from the textile product, and applying the afore-mentioned method to them.

When the A/B value, carrying ratio between both fibers, is small, difference in light and shade becomes conspicuous, and therefore, the ratio is preferably 0.75 or more. Further, since when the ratio becomes too large, homochromatic properties cannot be attained, the ratio is preferably 1.3 or less.

This heat treatment with saturated aqueous vapor can, for example, be carried out by a method of high pressure steaming (HP) which has so far been known, and a batch-type or continuous-type apparatus can be used as a steamer. Specifically, for example, cottage-type steamers, Dedeko textile steamers, beam-type steamers, etc., which are used for printing, can be used, and as an air dyeing finishing machine can be used a CUT-AJ-type air dyeing finishing machine produced by Hisaka Seisaku-sho Co., Ltd.

Particularly, when textile products having softer feeling is desired, when peach skin-like fibrilation is desired, or when the above A/B value of 0.90 or more is desired, it is effective to carry out the heating in saturated aqueous vapor using an air dyeing finishing machine.

EXAMPLES

The present invention is more specifically described below using examples, but this invention is not limited thereto.

In the present invention, average particle size, the amount of disperse dye carried on 1 g of cellulose fiber, wet strength and the content of fine particles were determined according to the following methods.

(1) Average particle size

As to fine particles observed in fiber sections magnified 5,000 to 20,000-fold, when the shapes thereof are true circles or almost circles, their diameters are measured, and when the shapes thereof are not circles, their major axes are measured. Such measurement is carried out on 5 or more sections, and then the average value of all the measured values is calculated. As to fine particle dispersions, particle size distribution is measured using Micro-track particle size measurement apparatus by laser, and particle size (MV value) at its maximum peak point is defined as average particle size.

(2) Amount of dye in the fiber

Amount of dye in the fiber is determined according to the above-mentioned measurement method of a degree of exhaustion, by the following equation, designating the dye concentration of the dye liquor before dyeing D {dye weight (mg) per g of the material dyed}.

Amount of dye in the fiber (mg/g)=$(S_0-S_1)\times D/S_0$ As dye liquor used, it is preferable to use a dye liquor of a single dye.

(3) Wet strength

A fiber sample is immersed in water of room temperature for 2 minutes, the final strength value is measured, in a wet state, at a tensile speed of 20 cm/24 sec., using a serimeter, and this measured value is divided by the weight fineness to give wet strength.

(4) Content of fine particles (=addition rate to the cellulose)

A previously weighed sample of regenerated cellulose fiber is dissolved in an aqueous alkali solution or a cuprammonium solution, the solution is filtered with a Teflon-made membrane filter or an ultrafiltration membrane, the filtered polymer fine particles are dried and weighed, and then the content of the fine particles per fiber weight is calculated.

EXAMPLE 1

To viscose (cellulose concentration 8.0%; alkali concentration 6.0%) was added 350g/1 of thick alkali solution, the mixture was mixed, 15% aqueous dispersion of polyethylene terephthalate fine particles (average particle size 3.5 μm) containing 7 weight % of $TiO_2$ was gradually added, the mixture was subjected to stirring and mixing using a high speed stirrer of 980 rpm, adjustment was made so that the addition rate of the fine particles to the cellulose could be 20% and the alkali concentration could be 7.0%, and vacuum defoaming was carried out for 2 hours to give a spinning solution.

Then, this spinning solution was discharged through a spinneret of 0.07 mm×40 holes into a coagulation-regeneration bath ($H_2SO_4$=155 g/1; $ZnSO_4$=4.22 g/1; $Na_2SO_4$=250 g/1; bath temperature=60° C. ) at a discharge amount of 9.35 cc/min, and the resultant yarn was drawn at a spinning speed of 100 m/min and a draw ratio of 18% using a so far known continuous spinning machine, scoured, dried and taken up. The obtained yarn had a weight fineness of 102.3 deniers, a dry strength of 1.38 g/d and a wet strength of 0.56 g/d.

The degree of dye exhaustion of this yarn was 78.3% under the standard dyeing condition.

The yarn was made into fabric by a small cylindrical knitting machine, dyeing was carried out under a condition of a bath ratio of 7:50 and an owl of 3% for 60 minutes using a disperse dye Sumikaron Blue S-3 RF, reduction cleaning was carried out at 80° C. for 20 minutes using a solution containing 1 g/l NaOH, 1 g/l $Na_2S_2O_4$ and 1 g/l Amiladin (produced by Dai-ichi Kogyo Seiyaku Co., Ltd.), and then washing (30 minutes) and drying (60° C.×10 minutes) were carried out.

As a result, the fabric was dyed to be a deep color with an amount of dye in the fiber of 25.7 mg/g, had a color fastness to washing (discoloration and fading) of the fifth grade, a color fastness to dry cleaning (discoloration and fading) of the fifth grade, a color fastness to light (discoloration and fading) of the fourth grade, a color fastness to sublimation (discoloration and fading) of the fourth grade and a color fastness to wet rubbing of the third to fourth grade, and thus had excellent color fastness, which was utterly different from the color fastness of usual rayon knitted fabric. Further, the degree of disperse dye exhaustion of the obtained knitted fabric was 85.7%.

EXAMPLE 2

To the same viscose as in Example 1 was added 350 g/l of thick alkali solution, the mixture was mixed, 27.5% aqueous dispersion of styrene-acrylic polymer fine particles (HP91 produced by Rohm & Haas Co.; average particle size 1 μm) was added gradually, the mixture was subjected to stirring and mixing using a high speed stirrer of 1,000 rpm, adjustment was made so that the addition rate of the fine particles to the cellulose could be 20% and the alkali concentration could be 7.0%, and standing defoaming was carried out all day and night to give a spinning solution.

Then, this spinning solution was discharged through a spinneret of 0.07 mm×40 holes into a coagulation-regeneration bath (the composition and temperature of the coagulation-regeneration bath are the same as in Example 1) at a discharge amount of 11.9 cc/min, and the resultant yarn was drawn at a spinning speed of 90 m/min and a draw ratio of 20% using a so far known centrifugal spinning machine, rolled round a pot, scoured and dried. The obtained yarn had a weight fineness of 131.4 deniers, a dry strength of 1.50 g/d and a wet strength of 0.65 g/d.

The degree of dye exhaustion of this yarn was 85.1% under the standard dyeing condition.

The yarn was made into fabric by a small cylindrical knitting machine, dyeing was carried out under the condition of a bath ratio of 1:50 and an owl of 3% at 130° C. for 60 minutes using a disperse dye Sumikaron Blue S-3RF, reduction cleaning, washing and drying were made in the same manner as in Example 1.

As a result, the fabric was dyed to be a deep color with an amount of dye in the fiber of 25.9 mg/g, had a color fastness to washing (discoloration and fading) of the fourth to fifth grade, a color fastness to dry cleaning (discoloration and fading) of the fourth to fifth grade, a color fastness to light (discoloration and fading) of the fourth grade, a color fastness to sublimation (discoloration and fading) of the fourth grade and a color fastness to wet rubbing of the third grade, which were good. Further, the degree of disperse dye exhaustion was 86.3% under this condition.

EXAMPLE 3

To the same viscose as in Example 1 was added 350 g/l of thick alkali solution, the mixture was stirred at a number of revolution of 500 rpm for 15 minutes, 25% dispersion of styrene-acrylic polymer fine particles (OP62 produced by Rohm & Haas Co.; average particle size 0.45 μm) was added, and the mixture was adjusted so that the addition rate of the fine particles to the cellulose could be 15% and the alkali concentration could be 7.0%, and stirred again at a number of revolution of 500 rpm for one hour. The mixture was then subjected to vacuum defoaming all day and night while stirred at a low speed of 50 rpm.

Then, this spinning solution was discharged through a spinneret of 0.07 mm×40 holes into a coagulation-regeneration bath (the composition of the coagulation-regeneration bath is the same as in Example 1; bath temperature was 50° C.) at a discharge amount of 10.45 cc/min (95% of a usual discharge amount since there is a light-weight rate of 5%), and the resultant yarn was rolled at a spinning speed of 100 m/min, an immersion length of 150 mm and a draw ratio of 18% using a usual pot centrifugal rolling type spinning machine, scoured and dried. During this spinning, a speed up rate of 7.5% was applied for denier adjustment between the inner layer and the outer layer, but guide adjustment was made to be a constant value of 12° for giving level dyeing. The number of days of up to the time when clogging occurs on the nozzle metal plate and the filter, which is reflecting smoothness of spinning, was about 10 days.

The resultant yarn had an average fineness of 109.7 deniers, a dry strength of 1.37 g/d and a wet strength of 0.63 /d. The average value of the content of fine particles and the difference in the content of fine particles between the inner layer and the outer layer were 14.4% and 1.2%, respectively. The difference (R) in dyeing concentration with disperse dye between the inner layer and the outer layer was 0.7, and such lowering of difference in dyeing concentration was attained that the above difference (R) in dyeing concentration was about one fourth of the difference (R) in dyeing concentration with direct dye on rayon which was 2.7. The degree of dye exhaustion of this yarn was 85.2% under the standard dyeing condition. Further, this cake yarn had a color fastness to washing, a color fastness to dry cleaning, a color fastness to sublimation and a color fastness to light of the third grades or better, respectively.

Further, in the case of dyeing with the direct dye, the innermost layer was deepest colored, whereas in the case of dyeing with the disperse dye, the innermost layer was not deep colored.

Fineness, physical properties, dyeing concentration and fine particle content in each layer of the cake yarn were shown in Table 1.

TABLE 1

| | Fineness | Dry strength | Dry elongation | Wet strength | Wet elongation | Dyeing concentration Direct dye | Dyeing concentration Disperse dye | Content of fine particles |
|---|---|---|---|---|---|---|---|---|
| Example 3 | | | | | | | | |
| Outer layer | 108.2 | 1.50 | 18.1 | 0.67 | 25.6 | 65.7 | 57.2 | 13.7 |
| Intermediate layer | 110.7 | 1.30 | 19.8 | 0.64 | 28.2 | 65.6 | 57.2 | 14.9 |
| Inner layer | 110.2 | 1.31 | 24.8 | 0.58 | 28.7 | 68.4 | 56.5 | 14.6 |
| Average | 109.7 | 1.37 | 20.8 | 0.63 | 27.5 | 66.6 | 57.1 | 14.4 |
| R | 2.5 | 0.19 | 6.4 | 0.09 | 3.1 | 2.7 | 0.7 | 1.2 |

EXAMPLE 4

Rayon cake yarn was prepared in the same manner as in Example 3 except that the addition amount of the polymer fine particles to the cellulose was 30%, a nozzle of 0.07 mm×30 holes was used and the discharge amount was set to 6.12 cc/min. In this occasion, the life time until clogging occurs on the nozzle metal plate and the filter was about 8 days.

The resultant yarn had an average fineness of 65.7 deniers, a dry strength of 1.20 g/d and a wet strength of 0.48 g/d. The degree of dye exhaustion of this yarn was 88% under the standard dyeing condition. The average value of the content of fine particles and the difference in the content of fine particles between the inner layer and the outer layer were 27.8% and 1.9%, respectively. The difference (R) in dyeing concentration with disperse dye between the inner layer and the outer layer was 1.5, and such lowering of difference in dyeing concentration was attained that the above difference (R) in dyeing concentration was about half of the difference (R) in dyeing concentration with direct dye on rayon which was 3.1.

In the case of dyeing with the direct dye, the innermost layer was deepest colored, whereas in the case of dyeing with the disperse dye, the innermost layer was not deep colored. Further, this cake yarn had a color fastness to washing, a color fastness to dry cleaning, a color fastness to sublimation and a color fastness to light of the third grades or better, respectively.

EXAMPLE 5

Rayon cake yarn was prepared in the same manner as in Example 3 except that acrylic fine particles having an average particle size of 4.0 μm were used, the addition amount of the fine particles to the cellulose was 15%, a nozzle of 0.07 mm×30 holes was used and the discharge amount was set to 6.47 cc/min. In this occasion, the life time until clogging occurs on the nozzle metal plate and the filter was about 5 days.

The resultant yarn had an average fineness of 70.0 deniers, a dry strength of 1.16 g/d and a wet strength of 0.45 g/d. The degree of dye exhaustion of this yarn was 81.6% under the standard dyeing condition. The average value of the content of fine particles and the difference in the content of fine particles between the inner layer and the outer layer were 14.5% and 1.4%, respectively. The difference (R) in dyeing concentration with disperse dye between the inner layer and the outer layer was 1.0, and remarkable lowering of difference in dyeing concentration was attained, compared with the difference (R) in dyeing concentration with direct dye on rayon which was 5.5.

In the case of dyeing with the direct dye, the innermost layer was deepest colored, whereas in the case of dyeing with the disperse dye, the innermost layer was not deep colored.

EXAMPLE 6

To the same viscose as in Example 1 was added 350 g/1 of thick alkali solution, the mixture was mixed, 27.5% aqueous dispersion of styrene-acrylic polymer fine particles (OP62 produced by Rohm & Haas Co.; average particle size 0.45 μm) was added gradually, the mixture was subjected to stirring and mixing using a high speed stirrer of 500 rpm, adjustment was made so that the addition rate of the fine particles to the cellulose could be 25% and the alkali concentration could be 7.5%, and standing defoaming was carried out all day and night to give a spinning solution.

Then, this spinning solution was discharged through a spinneret of 0.07 mm×40 holes into a coagulation-regeneration bath (the composition and temperature of the coagulation-regeneration bath are the same as in Example 1) at a discharge amount of 7.95 cc/min, and the resultant yarn was drawn at a spinning speed of 100 m/min and a draw ratio of 18% using a so far known centrifugal spinning machine, rolled round a pot, scoured and dried. The obtained yarn had a weight fineness of 82.5 deniers, a dry strength of 1.46 g/d and a wet strength of 0.61 g/d.

The degree of dye exhaustion of this yarn was 87.4% under the standard dyeing condition.

The yarn was made into fabric by a small cylindrical knitting machine, and the fabric was dyed under the condition of a bath ratio of 1:30 and an owl of 18% at 130° C. for 60 minutes using a disperse dye Kayaron Polyester Black 2R-SF, reduction cleaned at 85° C. for 20 minutes using a solution containing 1.5 g/1 NaOH, 4 1.5 g/1 $Na_2S_2O_4$ and 1.5 g/1 Amiladin (produced by Dai-ichi Kogyo Seiyaku Co., Ltd.), and then washed (30 minutes) and dried (60° C.×10 minutes).

As a result, the fabric was dyed to be an extremely deep color with an amount of dye in the fiber of 177 mg/g, had a color fastness to washing (discoloration and fading) of the fourth to fifth grade, a color fastness to dry cleaning (discoloration and fading) of the fourth to fifth grade, a color fastness to light (discoloration and fading) of the fourth to fifth grade, a color fastness to sublimation (discoloration and fading) of the fourth to fifth grade and a color fastness to wet rubbing of the fourth grade, which were good. Further, the degree of disperse dye exhaustion was 98.3% under this condition.

EXAMPLE 7

To the same viscose as in Example 1 was added 350 g/1 of thick alkali solution, the mixture was mixed, 15% aqueous dispersion of methyl methacrylate polymer fine particles (average particle size 0.3 μm) was added gradually, the mixture was subjected to stirring and mixing using a high speed stirrer of 1,020 rpm, adjustment was made so that the addition rate of the fine particles to the cellulose could be 20% and the alkali concentration could be 7.3%, and standing defoaming was carried out all day and night to give a spinning solution.

Then, this spinning solution was discharged through a spinneret of 0.07 mm×30 holes into a coagulation-regeneration bath (the composition and temperature of the coagulation-regeneration bath are the same as in Example 1) at a discharge amount of 7.02 cc/min, and the resultant yarn was drawn at a spinning speed of 100 m/min and a draw ratio of 18% using a so far known centrifugal spinning machine, rolled round a pot, scoured and dried. The obtained yarn had a weight fineness of 67.7 deniers, a dry strength of 1.61 g/d and a wet strength of 0.77 g/d.

The degree of dye exhaustion of this yarn was 83.1% under the standard dyeing condition.

The yarn was made into fabric by a small cylindrical knitting machine, and the fabric was dyed under the condition of a bath ratio of 1:50 and an owf of 3% at 130° C. for 60 minutes using a disperse dye Sumikaron Blue S-3RF, and then, reduction cleaning, washing and drying were carried out under the same conditions as in Example 1.

As a result, the fabric was dyed to be a deep color with an amount of dye in the fiber of 26.9 mg/g, had a color fastness to washing (discoloration and fading) of the fourth to fifth grade, a color fastness to dry cleaning (discoloration and fading) of the fourth to fifth grade, a color fastness to light (discoloration and fading) of the fourth grade, a color fastness to sublimation (discoloration and fading) of the fourth grade and a color fastness to wet rubbing of the third grade, which were good. Further, the degree of disperse dye exhaustion was 89.7% under this condition.

Comparative Example 1

To the same viscose as in Example 1 was added 350 g/1 of thick alkali solution, the mixture was mixed, 25.0% aqueous dispersion of styrene-acrylic polymer fine particles (OP62 produced by Rohm & Haas Co.; average particle size 0.45 μm) was added gradually, the mixture was subjected to stirring and mixing using a high speed stirrer of 500 rpm, adjustment was made so that the addition rate of the fine particles to the cellulose could be 0.5% and the alkali concentration could be 6.0%, and standing defoaming was carried out all day and night to give a spinning solution.

Then, this spinning solution was discharged through a spinneret of 0.07 mm×40 holes into a coagulation-regeneration bath (the composition and temperature of the coagulation-regeneration bath are the same as in Example 1) at a discharge amount of 9.35 cc/min, and the resultant yarn was drawn at a spinning speed of 100 m/min and a draw ratio of 18% using a so far known centrifugal spinning machine, rolled round a pot, scoured and dried. The obtained yarn had a weight fineness of 96.4 deniers, a dry strength of 1.61 g/d and a wet strength of 0.78 g/d.

The degree of dye exhaustion of this yarn was 8.8% under the standard dyeing condition.

Comparative Example 2

Spinning, drawing, rolling, scouring and drying were carried in the same manner as in Comparative example 1 except that the addition amount of the fine particles to the cellulose was made to be 2%.

The obtained yarn had a weight fineness of 95.7 deniers, a dry strength of 1.58 g/d and a wet strength of 0.76 g/d.

The degree of dye exhaustion of this yarn was 15.0% under the standard dyeing condition.

Comparative Example 3

Spinning, drawing, rolling, scouring and drying were carried in the same manner as in Comparative example 1 except that the addition amount of the fine particles to the cellulose was 5% and the discharge amount was 8.88 cc/min. The obtained yarn had a weight fineness of 92.9 deniers, a dry strength of 7.55 g/d and a wet strength of 0.71 g/d.

The degree of dye exhaustion of this yarn was 50.1% under the standard dyeing condition.

EXAMPLE 8

To the same viscose as in Example 1 was added 350 g/1 of thick alkali solution, the mixture was mixed, 15% aqueous dispersion of polyester fine particles (average particle size 3.5 μm) composed of polyethylene terephthalate wherein 10 mol % of isophthalic acid was copolymerized was added gradually, the mixture was subjected to stirring and mixing using a high speed stirrer of 980 rpm, adjustment was made so that the addition rate of the fine particles to the cellulose could be 20% and the alkali concentration could be 7.0%, and vacuum defoaming was carried out for 2 hours to give a spinning solution.

Then, this spinning solution was discharged through a spinneret of 0.07 mm×40 holes into a coagulation-regeneration bath (the composition and temperature of the coagulation-regeneration bath are the same as in Example 1) at a discharge amount of 9.35 cc/min, and the resultant yarn was drawn at a spinning speed of 100 m/min and a draw ratio of 18% using a so far known continuous spinning machine, scoured, dried and reeled. The obtained yarn had a weight fineness of 102.3 deniers, a dry strength of 1.38 g/d and a wet strength of 0.56 g/d.

The yarn was knitted by a 20 gauge cylindrical knitting machine and dyed under the same standard dyeing condition as mentioned above, and as a result, the carried amount was 24.0 mg/g, and the degree of disperse dye exhaustion was 80%.

The color fastness of the fabric after dyeing was as follows.

| | |
|---|---|
| Color fastness to washing (discoloration and fading) | fifth grade |
| Color fastness to dry cleaning (discoloration and fading) | fifth grade |
| Color fastness to sublimation (discoloration and fading) | fifth grade |
| Color fastness to light (discoloration and fading) | fourth grade |

The above disperse dye-dyeable rayon yarn, and polyester filaments of 75 d/24 f obtained from polyethylene terephthalate containing 0.2% of $TiO_2$ by usual spinning and drawing (spinning speed 1,000 m/min; draw ratio of 3.5 fold; drawing temperature 65° C.; set temperature 140° C.) were subjected to interlace filament combination (yarn speed 300 m/min; air pressure 2 kg/cm$^2$) to give conjugate combined filament yarn. In this connection, when fabric obtained by cylindrically knitting the same 75 d/24 f polyester filaments as used above alone was dyed under the above standard dyeing condition, the degree of dye exhaustion was 82%.

Then, the above conjugate combined filament yarn was twisted 400 turns/m (S twisting), and the resultant yarn was woven using it as warp yarn and filling yarn into a plain woven fabric. This fabric was scoured and relaxed, and then dyed under the same conditions as mentioned above except that the bath ratio was changed to 1:15. After dyeing, the fabric was unraveled to give pieces of yarn, the pieces of yarn were untwisted respectively and separated into polyester filaments and rayon, samples of them were taken at each load of 0.1 g/d, L*, a* and b* of each sample were measured, and thereby ΔE* was calculated. The resultant ΔE* was 3.0, and, so long as the the fabric was visually observed, the rayon yarn and the polyester yarn were indistinguishable and could be regarded as having the same color.

Color fastness of the dyed fabric was as follows, which was just in the same level as polyester.

| | |
|---|---|
| Color fastness to washing (discoloration and fading) | fifth grade |
| Color fastness to dry cleaning (discoloration and fading) | fifth grade |
| Color fastness to sublimation (discoloration and fading) | fifth grade |
| Color fastness to light (discoloration and fading) | fourth grade |

EXAMPLE 9

The plain woven fabric obtained in Example 8 was dyed, under the following conditions, with a dye wherein three primary colors were compounded.

| | |
|---|---|
| Dye; Dianix Yellow UN-SE200 | 1% owf |
| Dianix Ped UN-SE | 1% owf |
| Dianix Blue UN-SE | 1% owf |
| Auxiliary; Disper TL | 1 g/l |
| Ultra MT Level | 1 g/l |
| Bath ratio; 1:10 | |
| Dyeing temperature & time; The temperature is increased from 40° C. to 130° C. in 30 minutes, kept at 130° C. for 40 minutes and then decreased. After the dyeing, reduction cleaning was carried out at 80° C. for 20 minutes (1 g/l NaOH, 1 g/l $Na_2S_2O_4$ and 1 g/l Amiladin (produced by Dai-ichi Kogyo Seiyaku Co., Ltd.)), washing is made for 30 minutes, and drying is made at 60° C. for 10 minute. | |

When the fabric after the dyeing was visually observed in the same manner as in Example 8, the fabric had a plain appearance having high homochromatic properties without mixed color. ΔE* determined in the same manner as in Example 8 was 2.6.

The degree of dye exhaustion of the rayon yarn alone and that of the polyester yarn alone under this condition, when measured on knitted fabric by cylindrical knitting machine of each yarn, 91.5% and 93%, respectively. Further, the color fastness of the fabric of this example was good, as shown below.

| | |
|---|---|
| Color fastness to washing (discoloration and fading) | fourth to fifth grade |
| Color fastness to dry cleaning (discoloration and fading) | fourth to fifth grade |
| Color fastness to sublimation (discoloration and fading) | fourth to fifth grade |
| Color fastness to light (discoloration and fading) | fourth to fifth grade |

EXAMPLE 10

The rayon yarn obtained in Example 2 was subjected to interlace filament combination with polyester filaments and then weaving in the same manners as in Example 8. Then, dyeing was carried in the same manner as in Example 8 except that the bath ratio and dyeing time at the dyeing were changed to 1:5 and 20 minutes, respectively. After the dyeing, the fabric was unraveled to give pieces of yarn, the pieces of yarn were untwisted respectively and separated into polyester filaments and rayon, samples of them were taken at each load of 0.1 g/d, L*, a* and b* of each sample were measured, and thereby ΔE* was calculated. The resultant ΔE* was 3.8, and, so long as the the fabric was visually observed, the rayon yarn and the polyester yarn were indistinguishable and could be regarded as having the same color.

Color fastness of the dyed fabric was as follows, which was just in the same level as polyester.

| | |
|---|---|
| Color fastness to washing (discoloration and fading) | fifth grade |
| Color fastness to dry cleaning (discoloration and fading) | fifth grade |
| Color fastness to sublimation (discoloration and fading) | fifth grade |
| Color fastness to light (discoloration and fading) | fourth grade |

EXAMPLE 11

Viscose rayon yarn was obtained in the same manner as in Example 2 except that styrene-acrylic polymer fine particles (OP62 produced by Rohm & Haas Co.; average particle size 0.45 μm) were used as polymer fine particles and the addition of the fine particles to the cellulose was made to be 30%. The obtained yarn had a weight fineness of 130 deniers, a dry strength of 1.45 g/d and a wet strength of 0.56 g/d. The degree of disperse dye exhaustion of this yarn was 88%. This yarn and the same polyester filaments as used in Example 8 were subjected to filament combination and weaving in the same manner as in Example 8, and the resultant fabric was dyed under the following conditions.

| | |
|---|---|
| Dye; Sumikaron Navy Blue S-2GL | 8% owf |
| Bath ratio; 1:5 | |
| Auxiliary; Disper TL | 1 g/l |
| Ultra MT Level | 1 g/l |
| Temperature and time of dyeing; 120° C. × 20 minutes (temperature is increased from 40° C. to 120° C. in 30 minutes and kept at 120° C. for 20 minutes) | |
| Reduction cleaning; 80° C. × 20 minutes (1 g/l NaOH, 1 g/l $Na_2S_2O_4$ and 1 g/l Amiladin (produced by Dai-ichi Kogyo Seiyaku Co., Ltd.)), washing 30 minutes and drying 60° C. × 10 minutes. | |

The ΔE* of the fabric after the dyeing was 2.5, and the fabric had a plain appearance having homochromatic properties. The amount of dye in the rayon yarn alone and the polyester yarn alone under this condition were 63 mg/g and 60 mg/g, respectively. Further, various color fastnesses of the fabric of this example were excellent, as shown below.

| | |
|---|---|
| Color fastness to washing (discoloration and fading) | fourth to fifth grade |
| Color fastness to dry cleaning (discoloration and fading) | fourth to fifth grade |
| Color fastness to sublimation (discoloration and fading) | fourth to fifth grade |
| Color fastness to light (discoloration and fading) | fourth grade |

EXAMPLE 12

The fabric of Example 10 was dyed and finished in the same manner as in Example 10 except that a dye concentration was made to be 0.3% owf and the reduction cleaning was omitted, whereby a dyed fabric was obtained having a light color, having such high homochromatic properties that ΔE* is 2.2, and having a plain appearance. The amount of dye in the rayon yarn alone and the polyester yarn alone under this condition were 1.2 mg/g and 1.3 mg/g, respectively. Further, various color fastnesses of the fabric of this example were excellent, as shown below.

| | |
|---|---|
| Color fastness to washing (discoloration and fading) | fifth grade |
| Color fastness to dry cleaning (discoloration and fading) | fifth grade |
| Color fastness to sublimation (discoloration and fading) | fifth grade |
| Color fastness to light (discoloration and fading) | third to fourth grade |

EXAMPLE 13

The fabric of Example 10 was dyed and finished under the following conditions, and as a result, a dyed fabric was obtained having such high homochromatic properties that ΔE* is 2.7, and having a plain appearance.

| | |
|---|---|
| Dye; Kayaron Polyester Black 2R-SF | 12% owt |
| Bath ratio; 1:30 | |
| Auxiliary; Disper TL | 1 g/l |
| Ultra MT Level | 1 g/l |
| Temperature and time of dyeing; 120° C. × 20 minutes (temperature is increased from 40° C. to 120° C. in 30 minutes and kept at 120° C. for 20 minutes) | |
| Reduction cleaning; 80° C. × 20 minutes (1 g/l NaOH, 1 g/l $Na_2S_2O_4$ and 1 g/l Amiladin (produced by Dai-ichi Kogyo Seiyaku Co., Ltd.)), washing 30 minutes and drying 60 × 10 minutes | |

The amount of dye in the rayon yarn alone and the polyester yarn alone under this condition were 93 mg/g and 91 mg/g, respectively. Further, various color fastnesses of the fabric of this example were excellent as shown below.

| | |
|---|---|
| Color fastness to washing (discoloration and fading) | fourth to fifth grade |
| Color fastness to dry cleaning (discoloration and fading) | fourth to fifth grade |
| Color fastness to sublimation (discoloration and fading) | fourth to fifth grade |
| Color fastness to light (discoloration and fading) | fourth grade |

Comparative Example 4

Filament combination, weaving and dyeing were carried out in the same manner as in Example 8 except that viscose rayon (dry strength 1.6 g/d, wet strength 0.78 g/d and degree of disperse dye exhaustion 5%) obtained in all the same manner as in Example 8 except that the addition amount of the fine particles to the cellulose was made to be 0.5% was used and the bath ratio was made to be 1:50. As a result, the polyester yarn was sufficiently dyed, whereas the rayon yarn was scarcely colored. Although the dyeing temperature was increased up to 135° C., the result was the same. Thus, it was found that when the addition rate of the fine particles was as low as adopted above, it was impossible to obtain a deeply dyed product.

EXAMPLEs 14 to 18 and Comparative Examples 5 to 7

The same spinning solution as in Example 2 was discharged through the same spinneret as in Example 2 into the same coagulation-regeneration bath as in Example 2 at a discharge amount of 6.8 cc/min, and the resultant yarn was drawn at a spinning speed of 90 m/min and at a draw ratio of 20% using a so far known continuous spinning machine, scoured, dried and reeled. The resultant yarn had a fineness of 75 deniers, a dry strength of 1.60 g/d and a wet strength of 0.67 g/d. Knitted fabric by cylindrical knitting machine of the resultant filaments was dyed under the standard dyeing condition, and it was found that the degree of disperse dye exhaustion of the fabric was 85.1%.

The filaments and polyethylene terephthalate filaments (75 dr/24 f) were subjected to interlace filament combination (yarn speed 300 m/min; air pressure 2 kg/cm$^2$) in the same manner as in Example 8 to give conjugate combined filament yarn. This conjugate combined filament yarn was twisted 300 turns/m (S twisting), and the resultant yarn was woven using it as warp yarn and filling yarn into a plain woven fabric. This PES/regenerated cellulose conjugate fabric was scoured, desized, preset, immersed in the same dye liquor as used above, squeezed up to the dye liquor content (%) shown in Table 2, and then subjected to high pressure steaming in saturated steam of temperature shown in Table 2 for 20 minutes or ordinary pressure steaming.

The degree of disperse dye exhaustion of the polyester filaments used under the standard dyeing condition was 82.1%.

The dyed fabric was unraveled to give pieces of yarn, 5 the pieces of yarn were untwisted respectively and separated into polyester filaments and regenerated cellulose fiber. A predetermined weight each of the filaments and the fiber were subjected to Soxhlet extraction using aqueous 57% pyridine solution. Each extract was diluted with aqueous 57% pyridine solution to a predetermined concentration, and measured for absorbance at the maximum absorption wavelength using a spectrophotometer, the amount of the dye carried was read from a separately prepared calibration curve, and the ratio A/B between the carried amounts on the regenerated cellulose fiber and the polyester fiber was calculated. Further, homochromatic properties between both fibers composing the fabric was assessed by visually judging the difference between light and shade in the dyed product. The tearing strength in the longitudinal direction of the fabric after the dyeing was measured by a pendulum method in accordance with JIS-L-1096. The results are shown in Table 2.

It is understood that when the ranges of the content of dye liquor, the temperature of saturated steam, the ratio between carried amounts A/B, etc. prescribed in the present invention are complied with, dyed products excellent in homochromatic properties, tearing strength, etc. can be obtained.

Various color fastnesses of the fabrics of the examples of the present invention were as follows.

| | |
|---|---|
| Color fastness to washing (discoloration and fading) | fifth grade |
| Color fastness to dry cleaning (discoloration and fading) | fifth grade |
| Color fastness to sublimation (discoloration and fading) | fifth grade |
| Color fastness to light (discoloration and fading) | fourth grade |

TABLE 2

| | Water amount | Temperature of saturated steam | Temperature of hot water of ordinary pressure | Amount of dye in the fiber (mg/g) | | Ratio between the carried amounts | Homochromatic | Tearing strength in the longitudinal direction |
|---|---|---|---|---|---|---|---|---|
| | (%) | (°C.) | (°C.) | A | B | A/B | properties | (g) |
| Example 14 | 80 | 130 | — | 14.2 | 15.8 | 0.9 | good | 580 |
| Example 15 | 80 | 110 | — | 11.6 | 15.4 | 0.75 | good | 600 |
| Example 16 | 40 | 130 | — | 13.2 | 13.8 | 0.95 | good | 585 |
| Example 17 | 60 | 130 | — | 13.7 | 14.8 | 0.93 | good | 580 |
| Example 18 | 95 | 130 | — | 12.9 | 15.6 | 0.83 | good | 575 |
| Comparative example 5 | 80 | — | 90 | 1.7 | 4.3 | 0.4 | poor | 600 |
| Comparative example 6 | 120 | 130 | — | 10.8 | 19.2 | 0.56 | poor | 550 |
| Comparative example 7 | 80 | 145 | — | 11.8 | 18.2 | 0.65 | somewhat poor | 200 |

EXAMPLEs 19 to 20 and Comparative Examples 8 to 9

To the same viscose as in Example 1 was added a predetermined amount of 350 g/1 thick alkali solution, the mixture was stirred, an aqueous dispersion of styrene-acrylic polymer fine particles (OP62 produced by Rohm & Haas Co.; average particle size 0.45 μm) was gradually added, the mixture was subjected to stirring and mixing using a high speed stirrer of 1,000 rpm, the addition rate of the fine particles to the cellulose was adjusted to 5%, 15%, 30% or 50%, the alkali concentration was adjusted to 7.0%, and standing defoaming was carried out all day and night to give a spinning solution.

Then, this spinning solution was discharged through a spinneret of 0.07 mm×40 holes into a coagulation-regeneration bath (the composition and temperature of the coagulation-regeneration bath are the same as in Example 1) at a discharge amount of 6.9 cc/min, and the resultant yarn was drawn at a spinning speed of 90 m/min and a draw ratio of about 20% using a so far known continuous spinning machine, scoured, dried and reeled. The resultant four kinds of yarn (75 d/40 f) had dry strengths of 1.55 g/d, 1.50 g/d, 1.41 g/d and 1.25 g/d and wet strengths of 0.71 g/d, 0.63 g/d, 0.51 g/d and 0.35 g/d, in turn from the one of the lowest addition amount.

The degrees of disperse dye exhaustion of these yarn under the standard dyeing condition were 46.9%, 85.2%, 89.7% and 97.8%, in turn from the one of the lowest addition amount.

Then, the same polyester filaments (75 d/24 f) as used in Example 8 and one kind of the above regenerated cellulose filaments (75 d/40 f) were subjected to interlace filament combination (yarn speed 300 m/min; air pressure 2 kg/cm$^2$) to give conjugate combined filament yarn. The conjugate combined filament yarn was twisted 300 turns/m (S twisting), and the resultant yarn was woven using it as warp yarn and filling yarn into a plain woven fabric.

These fabrics were scoured, desized, preset, immersed in the same dye liquor as used above and squeezed up to the dye liquor content (%) of 90%, batch-up was carried out, and then the fabrics were immediately put in an air dyeing finishing machine and held for 20 minutes in a circulating air current of saturated steam of 130° C. On each of these dyed products, the ratio A/B between the carried amounts on the regenerated cellulose fiber and the polyester fiber was assessed in the same manner as in Example 14. The results are shown in Table 3.

It is understood that when the range of the content of the polymer fine particles prescribed in the present invention is complied with, dyed products excellent in homochromatic properties, tearing strength, etc. can be obtained.

Various color fastnesses of the fabrics of the examples of the present invention were as follows.

| | |
|---|---|
| Color fastness to washing (discoloration and fading) | fifth grade |
| Color fastness to dry cleaning (discoloration and fading) | fifth grade |
| Color fastness to sublimation (discoloration and fading) | fifth grade |
| Color fastness to light (discoloration and fading) | fourth grade |

TABLE 3

| | Addition rate of fine particles | Amount of dye the fiber (mg/g) | | Ratio between the carried amounts | Homochromatic | Tearing strength in the longitudinal direction |
|---|---|---|---|---|---|---|
| | (%) | A | B | A/B | properties | (g) |
| Example 19 | 15 | 13.1 | 16.9 | 0.78 | good | 650 |
| Example 20 | 30 | 14.4 | 15.6 | 0.89 | good | 620 |
| Comparative example 8 | 5 | 6.2 | 23.8 | 0.26 | poor | 600 |
| Comparative example 9 | 50 | — | — | — | — | 200 |

EXAMPLE 21 and Comparative Examples 10 to 12

To the same viscose as in Example 1 was added 260 g/1 sodium hydroxide solution, the mixture was stirred, 30% aqueous dispersion of polyester fine particles having an average particle size of 4 μm composed of polyethylene terephthalate wherein 10 mol % of isophthalic acid was copolymerized was gradually added. The mixture was subjected to stirring and mixing using a high speed stirrer of 980 rpm, the addition rate of the fine particles to the cellulose was adjusted to 5%, 20%, the alkali concentration was adjusted to 7.0%, and vacuum defoaming was carried out for 2 hours to give a spinning solution.

Then, this spinning solution was discharged through a spinneret of 0.07 mm×40 holes into a coagulation-regeneration bath (the composition and temperature of the coagulation-regeneration bath are the same as in Example 1) at a discharge amount of 9.35 cc/min, and the resultant yarn was drawn at a spinning speed of 100 m/min and a draw ratio of about 18% using a so far known continuous spinning machine, scoured, dried and reeled. The dry strengths of the resultant two kinds of yarn (103 d/40 f) were 1.38 g/d on the one having 20% addition rate and 1.48 g/d on the one having 5% addition rate, and the wet strengths of them were 0.56 g/d on the one having 20% addition rate and 0.67 g/d on the one having 5% addition rate.

The degrees of disperse dye exhaustion of these yarn under the standard dyeing condition were 78% on the one having 20% addition rate and 46% on the one having 5% addition rate.

Then, the same polyester filaments (75 d/24 f) as used in Example 14 and one kind of the above regenerated cellulose filaments (103 d/40 f) were subjected to interlace filament combination (yarn speed 300 m/min; air pressure 2 kg/cm$^2$) to give conjugate combined filament yarn. The conjugate combined filament yarn was twisted 300 turns/m (S twisting), and the resultant yarn was woven using it as warp yarn and filling yarn into a plain woven fabric. Each of the resultant fabrics was scoured, desized, preset, printed with the following color paste, subjected to dry treatment at 110° C. for 3 minutes, and then subjected to high pressure steaming or ordinary pressure steaming for 40 minutes with saturated steam of temperature shown in Table 4, or high temperature steaming for 7 minutes with superheated steam.

Water in the color paste was almost removed by this drying treatment.

| [Composition of color paste] | | |
|---|---|---|
| Stock paste; SANPRINT AFP (produced by Sansho Co., Ltd.) 20% | 550 parts | (100% owp) |
| Dye; Sumikaron Brill Red SE-2BF | 50 parts | (5% owp) |
| Tartaric acid (50%) | 5 parts | |
| Sodium chlorate | 3 parts | |
| Water | 392 parts | |

Then, washing and reduction cleaning (1 g/1 NaOH, 1 g/1 $Na_2S_2O_4$ and 1 g/1 Amiladin (produced by Dai-ichi Kogyo Seiyaku Co., Ltd.; 70° C.×20 minutes) were carried out, and drying was made. Each of these fabrics was unraveled on the printed part, the resultant pieces of yarn were untwisted and separated into polyester filaments and regenerated cellulose, the amount of the dye carried on each of them was measured, the ratio A/B between the carried amounts on the regenerated cellulose fiber and the polyester fiber was calculated. Further, homochromatic properties between both fibers composing the fabric were assessed by visually judging the difference between light and shade in the dyed product. The results are shown in Table 4.

Various color fastnesses of the fabrics of the example of the present invention and the comparative examples were as follows.

| | Example 21 | Comparative example 10 | Comparative example 11 | Comparative example 12 |
|---|---|---|---|---|
| Color fastness to washing (discoloration and fading) | fifth grade | fifth grade | fourth grade | fifth grade |
| Color fastness to dry cleaning (discoloration and fading) | fifth grade | fifth grade | fourth grade | fifth grade |
| Color fastness to sublimation (discoloration and fading) | fifth grade | fifth grade | fifth grade | fifth grade |
| color fastness to light (discoloration and fading) | fifth grade | third grade | second grade | third grade |

TABLE 4

| | Addition rate of fine particles | | Amount of dye the fiber (mg/g) | | Ratio between the carried amounts | Homochromatic | Tearing strength in the longitudinal direction |
|---|---|---|---|---|---|---|---|
| | (%) | Steaming condition | A | B | A/B | properties | (g) |
| Example 21 | 20 | Temperature of saturated steam 110° C. | 17.5 | 22.4 | 0.78 | good | 580 |
| Comparative example 10 | 5 | Temperature of saturated steam 130° C. | 2.6 | 7.4 | 0.35 | poor | — |
| Comparative example 11 | 20 | Ordinary pressure steaming 90° C. | 4.3 | 10.7 | 0.4 | poor | — |
| Comparative example 12 | 20 | Superheated steam 170° C. | 7.8 | 17.2 | 0.45 | poor | — |

INDUSTRIAL APPLICABILITY

The fiber of the present invention is the regenerated cellulose fiber which is dyeable with disperse dye and excellent in color fastnesses, suppressed lowering of the fiber strength in minimum. When it is used together with polyester fiber, the fiber of the present invention is dyeable together with the polyester fiber with disperse dye alone in the same bath at the same time, suitable for preparing textile products having homochromatic properties in accordance with desire and extremely suitable for outer clothing field.

What is claimed is:

1. A textile product comprising regenerated cellulose fiber containing 10 to 40 weight % of polymer fine particles with an average particle size of 0.05 to 5 μm which are dyeable with disperse dye, and polyester fiber.

2. A textile product comprising regenerated cellulose fiber containing 10 to 40 weight % of polymer fine particles with an average particle size of 0.05 to 5 μm which are dyeable with disperse dye, and polyester fiber, both fibers being dyed with disperse dye.

3. The textile product according to claim 2 wherein the homochromatic property $\Delta E^*$ fiber and the polyester fiber is 4 or less.

* * * * *